US006360501B1

(12) United States Patent
Litzenburger et al.

(10) Patent No.: US 6,360,501 B1
(45) Date of Patent: Mar. 26, 2002

(54) GUIDE UNIT FOR A TENSION MEMBER AT A STRUCTURAL COMPONENT

(75) Inventors: Ingolf Litzenburger; Oswald Nützel, both of München (DE)

(73) Assignee: Dyckerhoff & Widmann Aktiengesellschaft, München (DE)

( * ) Notice: Subject to any disclaimer, the term of this patent is extended or adjusted under 35 U.S.C. 154(b) by 0 days.

(21) Appl. No.: 09/365,447

(22) Filed: Aug. 2, 1999

(30) Foreign Application Priority Data

Aug. 4, 1998 (DE) ..... 298 13 941 U

(51) Int. Cl.[7] ..... E04C 5/20; E04B 1/22
(52) U.S. Cl. ..... 52/223.14; 52/223.1
(58) Field of Search ..... 52/223.13, 223.14, 52/223.3, 223.8, 223.12, 231, 223.1; 277/314, 315, 607, 631, 634, 626, 627

(56) References Cited

U.S. PATENT DOCUMENTS 3,241,278 A * 3/1966 Magers, Jr. ..... 52/223.3
3,462,175 A * 8/1969 Johnson ..... 277/607
4,075,801 A * 2/1978 Alper et al. ..... 52/223.3
4,848,052 A * 7/1989 Nutzel ..... 52/223.13
5,624,124 A * 4/1997 Ungchusri et al. ..... 277/607

FOREIGN PATENT DOCUMENTS

| | | | | |
|---|---|---|---|---|
| DE | 2327442 | * | 12/1973 | ..... 52/223.14 |
| DE | 3731721 | * | 4/1989 | ..... 52/223.14 |
| DE | 3734954 | | 7/1992 | |
| IT | 495581 | * | 2/1956 | ..... 52/223.14 |

* cited by examiner

*Primary Examiner*—Michael Safavi
(74) *Attorney, Agent, or Firm*—Friedrich Kueffner

(57) ABSTRACT

A guide or deflecting unit for a tension member at a structural component of a structure extending outside of the cross-section of the structure. The tension member extends with a change of direction over a deflection point formed at the structural component. The guide or deflection unit is composed of a tubular shaped piece of a deformable material which surrounds the tension member and whose contour is shaped in the longitudinal direction such that its wall thickness decreases from the middle toward the ends in accordance with the curvature of the required deflection. The predetermined curvature is obtained when tensioning the tension member by the contact thereof with a wall of a straight receiving opening.

4 Claims, 2 Drawing Sheets

Fig. 3
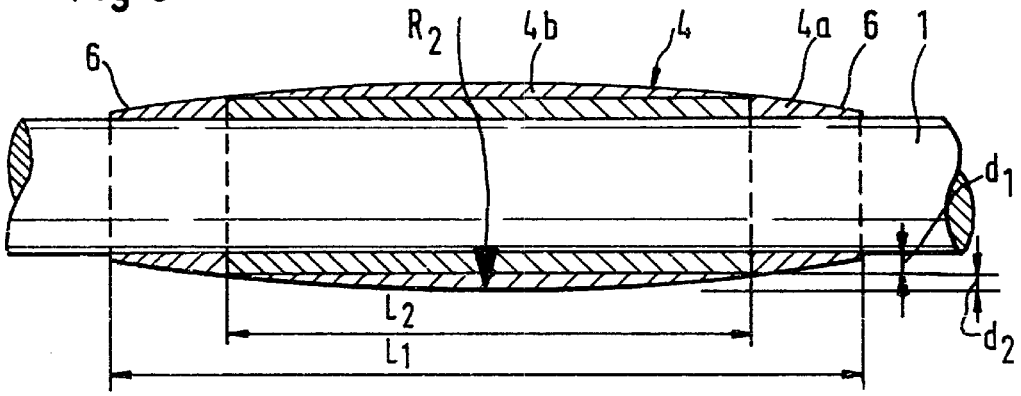
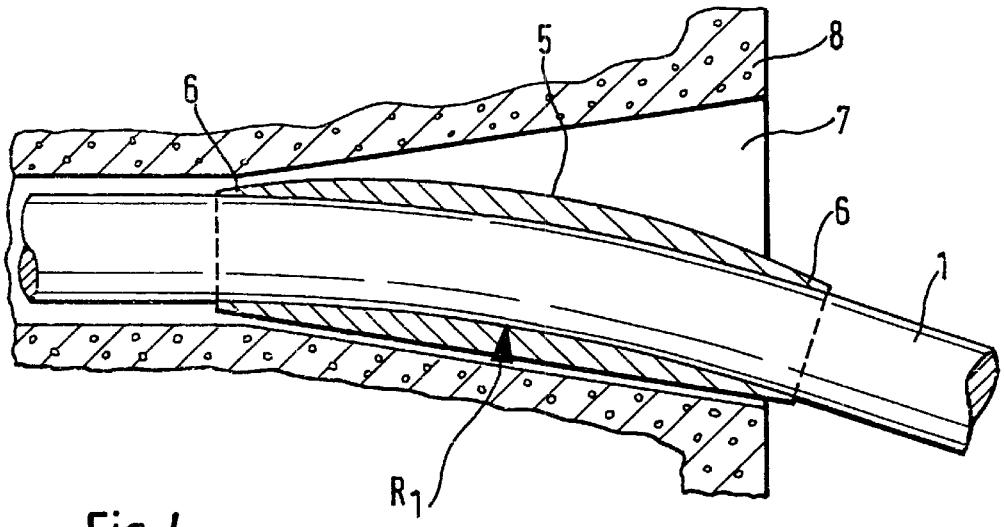
Fig. 4

GUIDE UNIT FOR A TENSION MEMBER AT A STRUCTURAL COMPONENT

BACKGROUND OF THE INVENTION

1. Field of the Invention

The present invention relates to a guide or deflecting unit for a tension member at a structural component of a structure extending outside of the cross-section of the structure, wherein the tension member extends with a change of direction over a deflection point formed at the structural component.

2. Description of the Related Art

When constructing structures of prestressed concrete, particularly in the case of bridge structures, prestressing is carried out with and without adhesion. Prestressing with adhesion is usually carried out as prestressing with subsequent adhesion, wherein the tension members are located within the cross-section of the concrete and adhesion to the structure is effected by injecting cement paste after the tension members have been tensioned. In the case of prestressing without adhesion, the tension members are located outside of the cross-section of the concrete, but are supported relative to the structure. As a result, these tension members, also called external tension members, can be checked, retensioned and also exchanged as necessary at any time. External tension members are also frequently used for rehabilitating or subsequently reinforcing bridges.

In external tension members, which extend essentially outside of the cross-section of the concrete, it is usually not possible to adapt the axis of the tension member continuously curved to the pattern of the bending moments; rather, it is necessary that the tension member follow a polygonal course. This produces guide or deflecting locations where deflection forces directed toward the inner side of the curvature must be absorbed.

In the case of greater angles of deflection, it is necessary for avoiding a kink in the course of the tension member to provide in the area of a deflection location a deflection saddle which has a curvature corresponding to the radius of curvature of the tension member, so that a soft absorption of the deflection forces is achieved.

In this connection, it is known in the art to use a steadily curved tube, particularly curved in the shape of a circular arc, through which the tension member extends in the area of a deflection location (DE 37 34 954 C2). Although the manufacture and assembly of such a curved tube is complicated, this configuration is acceptable if it is used in a structure to be newly manufactured and the curved tube can be accurately dimensioned and placed in the concrete. This configuration is too complicated if, for rehabilitating or reinforcing an existing structure, a curved tube must be placed, for example, into a bore and the hollow space remaining between the bore and the tube must be filled with hardening material, so that a problem-free transmission of the deflection forces is ensured. This produces additional requirements and delays the construction.

SUMMARY OF THE INVENTION

Therefore, in view of the prior art discussed above, it is the primary object of the present invention to provide a simple and economical possibility for ensuring a problem-free absorption of the deflection forces at the points of deflection of external tension members.

In accordance with the present invention, the guide or deflection unit is composed of a tubular shaped piece of a deformable material which surrounds the tension member and whose contour is shaped in the longitudinal direction such that its wall thickness decreases from the middle toward the ends in accordance with the curvature of the required deflection, so that the predetermined curvature is obtained when tensioning the tension member by the contact thereof with a wall of a straight receiving means.

Consequently, the basic concept of the invention resides in that a shaped piece surrounding the tension member is provided, wherein the outer contour of the shaped piece corresponds in the direction of the tension member axis with a negative sign to the radius of curvature of the deflection saddle to be provided and which, when the tensioning force is applied to the respective tension member, can be deformed together with the tension member in such a way that by contacting the wall of the straight receiving means the required deflection saddle is achieved. As a result, the guide or deflection unit according to the present invention can be used with particular advantage in the rehabilitation of bridges because it is only necessary for producing a deflection point to provide a straight receiving means, for example, a straight bore produced by core drilling. The desired deflection radius then automatically is produced with the correct magnitude independently of any existing tolerances. Since a dry assembly is possible, the assembly is inexpensive and fast.

In accordance with a useful feature of the present invention, the shaped piece is composed of a section of a tube of synthetic material, especially PE. In the case of such a tube, it is easily possible to produce the required con tour by processing, particularly by turning. If the wall thickness of a tube is not sufficient for accommodating the camber of the curvature of a deflection location, it is also possible to slide two or more tube sections concentrically onto one another, wherein the inner portion of the respectively inner tube has the normal wall thickness, while the required contour is provided at the tube sect ion placed over the inner tube.

Since external tension members usually have a circular cross-section, it is useful if the shaped piece according to the present invention also has a circular cross-section. However, the shaped piece may also have a rectangular cross-section or may be composed of individual plates which surround the tension member.

In order to achieve in all cases a complete contact of the shaped piece with the sheathing tube surrounding the tension member, it is useful to cut the shaped piece open in the longitudinal direction or, in the case of shaped pieces having greater diameters, to cut out an appropriate strip from the shaped piece. On the one hand, this makes it easier to carry out the assembly and, on the other hand, this produces the result that the shaped piece completely surrounds the tension member as a result of the restoring forces inherent in the synthetic material.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

BRIEF DESCRIPTION OF THE DRAWING

In the drawing:

FIG. 3 is a sectional view of another embodiment of the guide or deflection unit; and FIG. 4 is a sectional view showing the unit used in a truncated cone-shaped opening in the state of use.

DESCRIPTION OF THE PREFERRED EMBODIMENTS

Figure 1:
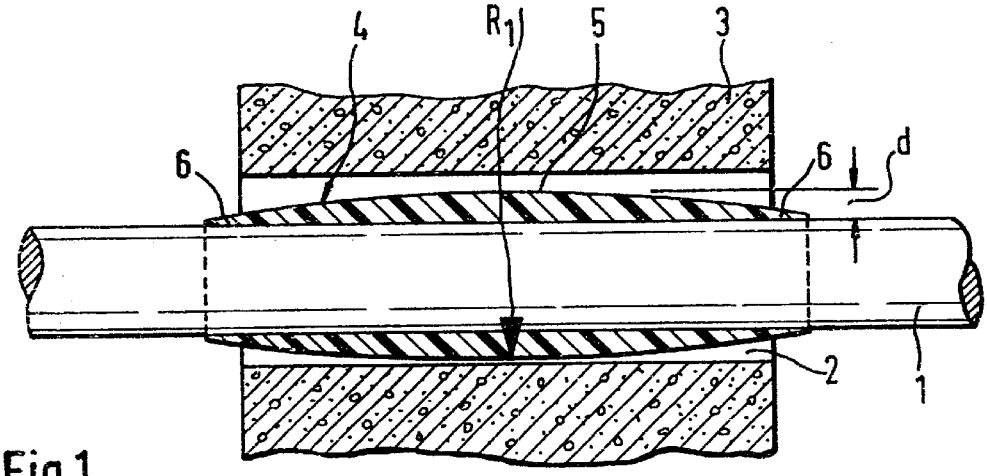
FIG. 1 is a sectional view of an embodiment of the guide or deflection unit according to the present invention shown in the state of assembly in a cylindrical opening.
Figure 2:
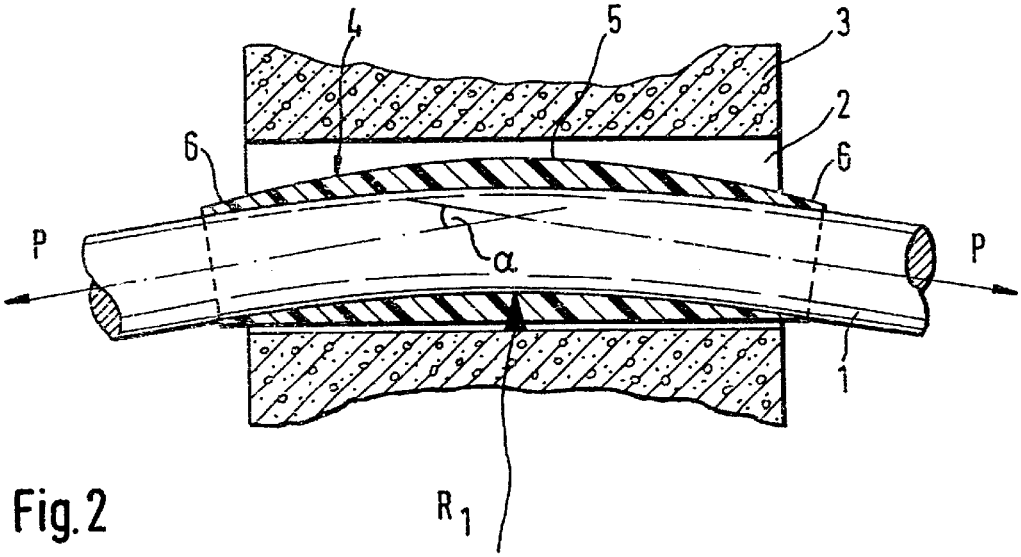
FIG. 2 is a sectional view of the unit of FIG. 1 shown in the state of use.

In the embodiment of the present invention illustrated in FIGS. 1 and 2, a tension member 1 extends through an opening 2 in a structural component 3 and is guided or deflected in such a way that a deflection location with a deflection saddle is formed in the lower area of the wall of the opening 2.

The tension member 1 is a conventional tension member in which a bundle of individual elements, for example, steel wire strands, are accommodated in a sheathing tube of synthetic material, for example, PE, having a circular cross-section. The structural components 3 may be, for example, a pilaster, a wall projection or the like, in which the opening 2 is cut as a cylindrical passage, for example, by core drilling. Of course, it is also possible to produce the opening 2 in a different manner.

In accordance with the present invention, a shaped piece 4 is placed on the tension member 1 in that area where the deflection point is to be produced. This shaped piece 4 is composed of a section of a tube of synthetic material, for example, PE, whose wall thickness d is reduced from the middle portion 5 toward the ends 6 in accordance with the curvature of the deflection location; in the illustrated embodiment, the curvature corresponds to the radius $R_1$. The wall thickness can be easily reduced, for example, by turning, milling cutting or the like.

The tubular shaped piece 4 can be slid onto the tension member 1. In order to facilitate the assembly and to ensure a complete contact, it is useful to cut the shaped piece 4 in the longitudinal direction; this makes it possible that the shaped piece 4 can be spread open and placed easily on the tension member 1 so that it completely surrounds the sheathing tube of the tension member 1 as a result of the restoring forces of the synthetic material. In the case of shaped pieces having greater diameters, it is also possible to cut a strip out of the tube wall in the longitudinal direction.

While FIG. 1 shows the state of assembly in which the tension member 1 is still straight, FIG. 2 shows the state of use. As shown in FIG. 2, by applying the tensioning force B on the tension member 1, the deflection angle $\alpha$ is obtained. This causes the shaped piece 4 to be deformed in such a way that the curved outer contour rests against the straight wall of the opening 2 and, thus, forms with the radius of curvature $R_1$ a complete and also soft support of the tension member 1 at the deflection location. The hollow space remaining between the shaped piece 4 and the opening 2 can be filled with a hardening material, for example, cement mortar.

FIG. 3 of the drawing shows an embodiment which is used when the angle of deflection of the tension member 1 is greater, i.e., the deflection radius is smaller and the camber of the curvature is greater than the wall thickness of a tube from which the shaped piece is manufactured. In this case, the shaped piece 4 according to the present invention is composed of a first inner part 4*a* having the length $L_1$ and a second part 4*b* slid over the first part 4*a*. The inner part 4*a* has a reduced thickness only at the ends 6, while the inner portion of the part 4*a* has a constant wall thickness $d_1$ over the length $L_2$. The second part 4*b* extends over the length $L_2$ and its wall thickness $d_2$ is reduced in the same manner as is the case in the shaped piece 4 according to FIG. 1. In this manner, a smaller radius of curvature $R_2$ can be realized.

FIG. 3 also makes it possible to show that, primarily in the case of longer passages, it is also possible to mount only the ends 6 of a shaped piece, while freely staying the tension member between the ends 6.

Finally, FIG. 4 shows that it is possible to arrange the shaped piece 4 according to the present invention in a conically widening passage opening 7 of a structural component 8 when the walls of the opening 7 are straight.

While specific embodiments of the invention have been shown and described in detail to illustrate the inventive principles, it will be understood that the invention may be embodied otherwise without departing from such principles.

We claim:

1. A guide unit for a tension member within an opening of a structural component of a structure, wherein, when the tension member is tensioned, the tension member extends with a curvature resulting in a change of direction over a surface of the opening at a deflection point of the structural component, the unit comprising a tubular shaped piece of a deformable material concentrically surrounding the tension member, the shaped piece having a contour in a longitudinal direction thereof with a wall thickness decreasing from a middle of the shaped piece toward ends of the shaped piece, the shaped piece having a shaped piece portion adjacent a surface of the opening, the shaped piece portion having an inner side facing the tension member and an outer side facing the surface of the opening, and wherein, when the tension member is tensioned, the inner side follows the curvature of the tension member and the outer side is straight and in contact with a straight wall of the receiving means.

2. The guide unit according to claim 1, wherein the shaped piece is of PE.

3. The guide unit according to claim 1, wherein the shaped piece has a contour which is straight at an inner side thereof and curved at an outer side thereof.

4. The guide unit according to claim 1, wherein the shaped piece is comprised of a plurality of parts arranged concentrically and centrally relative to each other.

* * * * *